US008646659B2

(12) United States Patent
Swanick

(10) Patent No.: US 8,646,659 B2
(45) Date of Patent: Feb. 11, 2014

(54) DISPENSING CONTAINER FOR DISPENSING PREDETERMINED AMOUNTS OF PRODUCT

(75) Inventor: Ken P. Swanick, Arlington Heights, IL (US)

(73) Assignee: Calibre Closures LLC, Downers Grove, IL (US)

( * ) Notice: Subject to any disclaimer, the term of this patent is extended or adjusted under 35 U.S.C. 154(b) by 170 days.

(21) Appl. No.: 13/216,404

(22) Filed: Aug. 24, 2011

(65) Prior Publication Data

US 2013/0048679 A1 Feb. 28, 2013

(51) Int. Cl.
*B65D 37/00* (2006.01)

(52) U.S. Cl.
USPC ..... 222/212; 222/556

(58) Field of Classification Search
USPC ..... 222/206, 212, 556, 491, 494; 215/343, 215/345, 355; 220/345.4
See application file for complete search history.

(56) References Cited

U.S. PATENT DOCUMENTS 2,864,367 A * 12/1958 Mende ..... 222/212
3,123,258 A 3/1964 Schiltz
3,366,284 A 1/1968 Marona et al.
3,472,411 A 10/1969 Turner
3,523,637 A * 8/1970 Stec ..... 383/98
3,581,605 A 6/1971 Taylor
4,221,291 A 9/1980 Hunt
4,506,809 A 3/1985 Corsette
4,747,497 A 5/1988 Holman
5,020,681 A 6/1991 Kusz
5,141,138 A 8/1992 Odet et al.
5,337,924 A * 8/1994 Dickie ..... 222/212
5,361,947 A * 11/1994 Lifshey ..... 222/212
5,482,176 A 1/1996 Maietta et al.
5,582,330 A 12/1996 Iba
5,897,033 A 4/1999 Okawa et al.
6,041,975 A * 3/2000 Flak ..... 222/212
6,089,411 A * 7/2000 Baudin et al. ..... 222/212
6,367,622 B1 4/2002 Hsu
6,422,412 B1 7/2002 Sagawa
6,477,743 B1 11/2002 Gross et al.

(Continued)

FOREIGN PATENT DOCUMENTS

WO WO 2009/151106 12/2009

OTHER PUBLICATIONS

Int'l Search Report & Written Opinion issued is application No. PCT/US10/47857 (2010).

(Continued)

*Primary Examiner* — Kevin P Shaver
*Assistant Examiner* — Patrick M Buechner
(74) *Attorney, Agent, or Firm* — Barnes & Thornburg LLP

(57) ABSTRACT

A vessel having a dispensing closure; a container engaged with the dispensing closure and having a pair of opposed walls defining a bore for receiving the product and having a relaxed state, the container being repeatedly squeezable to inwardly deflect from its relaxed state to cause the opposed walls to deflect inwardly to displace some of the product from the container into the dispensing closure for dispensing one of the predetermined amounts of product and being flexible to return its relaxed state after squeezing, and a limiting member disposed within the bore for limiting inward deflection of the opposed walls during each squeezing of the container to limit the amount of product displaced from the container into the dispensing closure. The limiting member has an H-shaped cross section substantially along its length.

16 Claims, 5 Drawing Sheets

(56) References Cited

U.S. PATENT DOCUMENTS

| | | | | |
|---|---|---|---|---|
| 6,484,909 | B1 * | 11/2002 | Valpuesta Landa | 222/541.5 |
| 6,513,650 | B2 | 2/2003 | Mollstam et al. | |
| 6,571,994 | B1 | 6/2003 | Adams et al. | |
| 6,679,375 | B1 | 1/2004 | Coory | |
| 6,702,161 | B2 | 3/2004 | Adams et al. | |
| 6,745,923 | B2 | 6/2004 | Julian | |
| 6,769,579 | B2 * | 8/2004 | Milian | 222/632 |
| 6,786,330 | B2 | 9/2004 | Mollstam et al. | |
| 6,851,576 | B2 | 2/2005 | Dubach | |
| 6,976,576 | B2 * | 12/2005 | Intini | 206/1.5 |
| 7,178,683 | B2 | 2/2007 | Birkmayer et al. | |
| 7,207,465 | B2 | 4/2007 | Weist | |
| 7,261,226 | B2 | 8/2007 | Adams et al. | |
| 7,337,921 | B2 | 3/2008 | Ma | |
| 7,367,964 | B2 | 5/2008 | Heinz et al. | |
| D571,199 | S | 6/2008 | Petrosino et al. | |
| 7,410,071 | B1 | 8/2008 | Seib et al. | |
| 7,635,070 | B2 * | 12/2009 | Cohen et al. | 222/214 |
| 7,934,615 | B2 * | 5/2011 | Hoffman et al. | 220/254.9 |
| 2003/0000963 | A1 | 1/2003 | Julian | |
| 2003/0106911 | A1 | 6/2003 | Adams et al. | |
| 2004/0149778 | A1 * | 8/2004 | Altonen et al. | 222/212 |
| 2006/0057257 | A1 | 3/2006 | Ma | |
| 2006/0108378 | A1 * | 5/2006 | Cohen et al. | 222/211 |
| 2007/0017939 | A1 * | 1/2007 | Conroy et al. | 222/556 |
| 2007/0034648 | A1 * | 2/2007 | Mathiez | 222/162 |
| 2007/0045134 | A1 | 3/2007 | Dvorak et al. | |
| 2007/0181522 | A1 | 8/2007 | Davidson | |
| 2008/0124432 | A1 | 5/2008 | Ma | |
| 2008/0156802 | A1 | 7/2008 | Yauk et al. | |
| 2009/0020495 | A1 | 1/2009 | Cheng | |
| 2009/0050648 | A1 | 2/2009 | Wisniewski | |
| 2010/0308082 | A1 * | 12/2010 | Lamble et al. | 222/162 |
| 2011/0049188 | A1 * | 3/2011 | Parisi et al. | 222/162 |

OTHER PUBLICATIONS

Int'l Search Report & Written Opinion issued is app. No. PCT/US2012/052092 (2012).

* cited by examiner

DISPENSING CONTAINER FOR DISPENSING PREDETERMINED AMOUNTS OF PRODUCT

The present disclosure relates to a vessel for containing liquids, semi-solids and powders.

BACKGROUND

Containers or other vessels with dispensing closures are used for a wide variety of liquid or other consumer products, including water, juices, condiments, medicines, extracts, cleaners, oils, detergents and other products. Depending on their designs, the dispensing closures can be opened and closed for dispensing the product without removing or separating any portion of the dispensing closure from the rest of the container. The vessels typically include a base container and a dispensing closure engaged thereto. To dispense a desired amount of the product, a user typically uses a measuring spoon, cup or other measuring device to receive and measure the correct quantity of dispensed product. It is difficult to dispense the same amount of product during each use with such consumer products. Further, there may be a loss of product on the external measuring device.

SUMMARY

The present disclosure relates to a vessel configured to contain liquid, semi-solid or powder product and to dispense predetermined amounts of the product. The vessel comprises a dispensing closure defining a flow opening; a container engaged with the dispensing closure having a relaxed state, the container being squeezable to inwardly deflect the container from its relaxed state to displace some of the product from the container into the dispensing closure for dispensing through the flow opening one of the predetermined amounts of the product and being flexible to return to its relaxed state after the squeezing, the container thereafter being squeezable to inwardly deflect the container from its relaxed state to displace some more of the product from the container into the dispensing closure for dispensing an other of the predetermined amounts of product through the flow opening and being flexible to return to its relaxed state after the squeezing; and a limiting member for limiting inward deflection of the container during each squeezing of the container to limit the amount of product displaced from the container into the dispensing closure.

The container may include a pair of opposed walls that define a bore and that are squeezable towards each other. The limiting member is disposed within the bore between the opposed walls. The limiting member may have a length that extends in substantially the same direction as a longitudinal axis of the container. The limiting member may have a H-shaped cross section substantially along its length and may include a rigid member having a width that extends between the pair of opposed walls and having a pair of opposed ends. The opposed ends are configured to contact the opposed walls during squeezing of the container to limit the inward deflection of the opposed walls. The dispensing closure may include a hinged overcap movable between open and closed positions to open and close the flow opening. The hinged overcap may include a living hinge secured to the overcap. The container in accordance with embodiments of the present disclosure may be used for any product, including, including water, soda juices and other beverages, condiments, medicines, extracts, creams, ointments, cleaners, oils, detergents and any other suitable consumer products, medical products, industrial products, etc.

Features and advantages of the disclosure will be set forth in part in the description which follows and the accompanying drawings described below, wherein one or more embodiments of the disclosure is described and shown, and in part will become apparent upon examination of the following detailed description taken in conjunction with the accompanying drawings.

BRIEF DESCRIPTION OF THE DRAWINGS

The present invention and the advantages thereof will become more apparent upon consideration of the following detailed description when taken in conjunction with the accompanying drawings.

DETAILED DESCRIPTION

Figure 1:
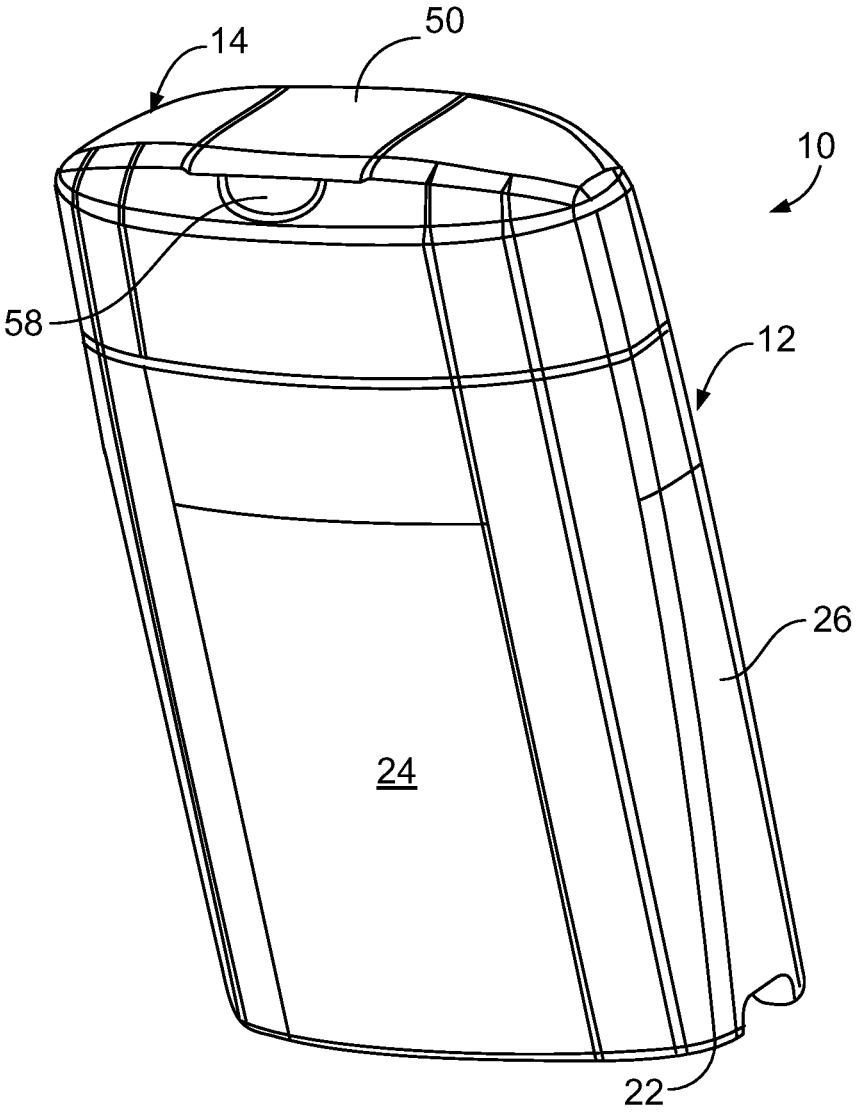
FIG. 1 is a front perspective view of a vessel in accordance with an illustrated embodiment of the present disclosure.
Figure 2:
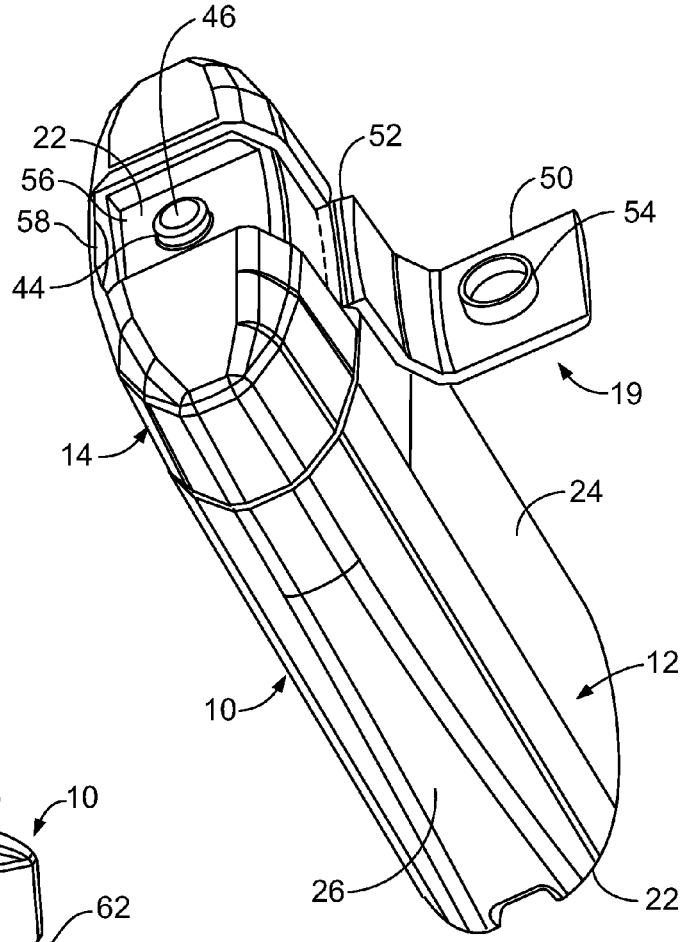
FIG. 2 is a side perspective view of the vessel of FIG. 1 illustrating the hinged overcap moved to an open position.
Figure 3:
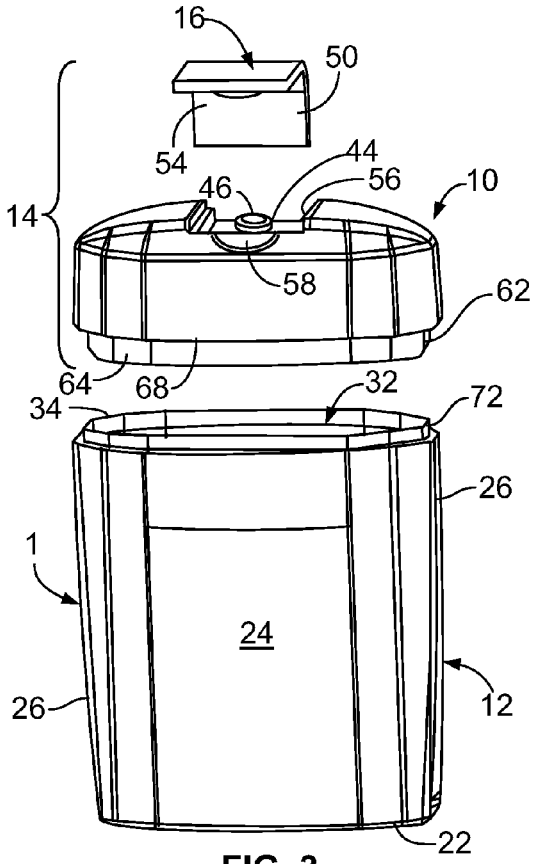
FIG. 3 is an exploded front view of the vessel of FIG. 1, illustrating the container, dispensing closure and the hinged overcap of the dispensing closure.

FIGS. 1-8 illustrate a vessel 10 for containing a liquid, semi-solid or powder product and for dispensing predetermined amounts of the product. The vessel 10 in accordance with an illustrated embodiment of the present disclosure comprises generally a container 12 for containing the product, a dispensing closure 14 engaged with or otherwise secured to the container 12, and a limiting member 16. The vessel 10 may have any suitable construction. It may, for example, be produced in one or more parts by injection molding and may be constructed of any suitable plastic or some other similar material, with the container 12 having a flexibility to be squeezable and return substantially to its relaxed state. The vessel 10 may be produced from any other suitable manufacturing method such as, for example, blow molding, thermoforming, casting, etc. which provides flexibility and an ability. The vessel 10 is designed to hold various viscosities of products.

The container 12 in accordance with an illustrated embodiment of the present disclosure 14 includes a base 22, a pair of inwardly-facing arcuate walls 24 and a pair of opposed wall segments 26 interconnecting the arcuate walls 24. The container 12 defines a bore 32 for receiving the product and an open end 34. Each wall segment 26 includes a detent 40 adjacent the open end 34 of the container 12 for engaging the dispensing closure 14. The dispensing closure 14 is engageable with the container 12 at the open end 34 of the container 12 and is configured to enclose the open end 34.

The dispensing closure 14 in accordance with an illustrated embodiment of the present disclosure 14 includes a spout 44 that defines a flow opening 46. The diameter and shape of the spout 44 and opening 46 may be tailored to the viscosity of the contents to prevent leaking when the container 12 is inverted. The calculation may be based on, for example, the specific gravity of the liquid or product in conjunction with equilibrium between the inside of the container 12 and outside atmosphere to ensure it does not drip until pressure is applied to the container 12 offsetting the equilibrium. Other dispensing spouts such as silicone or elastomer valves, check valves, etc. could also be used with the vessel 10 depending on the desired results.

The dispensing closure 14 also includes a hinged overcap 50 with a living hinge 52. The hinged overcap 50 is movable between open and closed positions for opening and closing the opening 46. The hinged overcap 50 further includes a sealing rim 54 for sealing the opening 46 and the dispensing closure 14 further defines a recess 56 for receiving the hinged overcap 50 when it is in the closed position. The dispensing closure 14 also includes a notch 58 to facilitate opening of the hinged overcap 50.

The dispensing closure 14 may be secured to the container 12 in any suitable manner. In the illustrated embodiment, for example, the dispensing closure 14 includes a pair of barb catches 62 or the like engageable with the detents 40 of the container 12 for locking or otherwise engaging the dispensing closure 14 and the container 12. The dispensing closure 14 also includes a recessed lip 64 extending substantially around the perimeter of its base for snugly engaging the inner wall of the container 12 adjacent the open end 34 of the container 12 and providing a seal. The dispensing closure 14 defines a slot 68 extending around the perimeter of the closure 14 adjacent the lip 64 to receive the rim 72 of the container 12. The dispensing closure 14 can be secured to the container 12 in any other suitable manner in accordance with other embodiments of the present disclosure 14, such as, for example, screw threads, sealants, adhesives, welding, etc.

Figure 4:
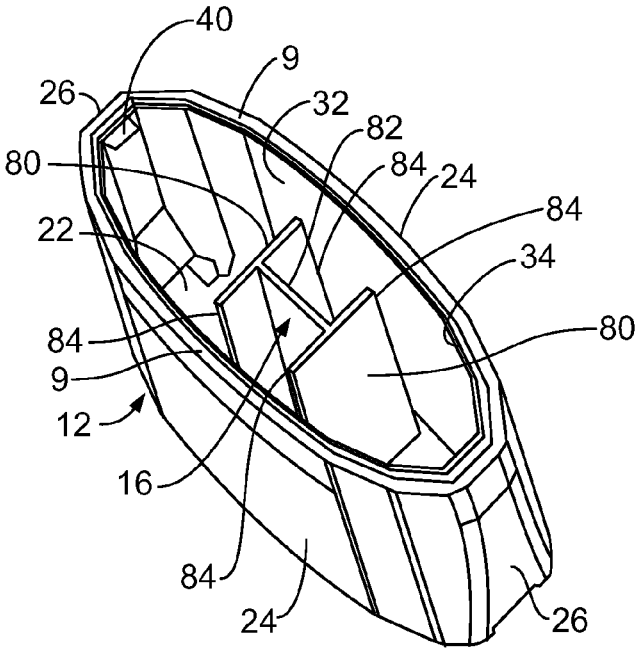
FIG. 4 is a top perspective view of the container of the vessel of FIG. 1.
Figure 5:
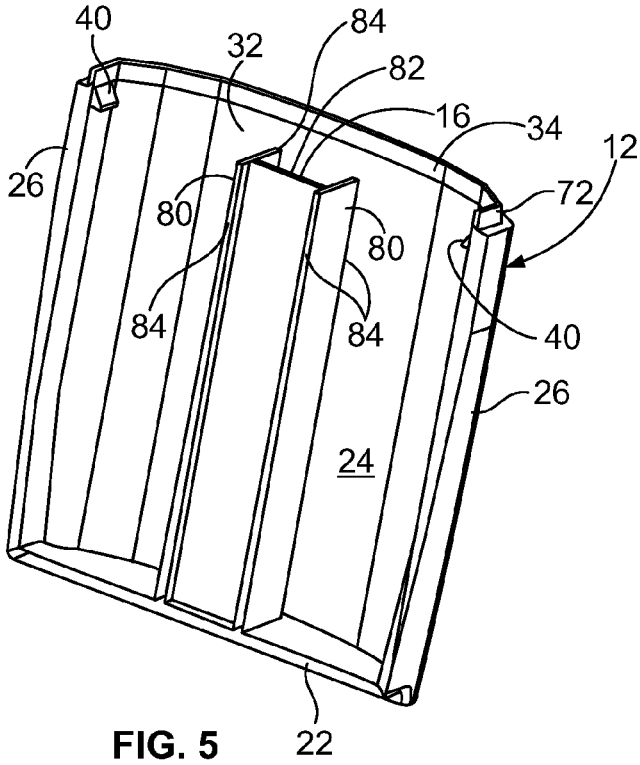
FIG. 5 is a side perspective of the container of FIG. 4 with a wall removed to illustrate the limiting member of the vessel.
Figure 6:
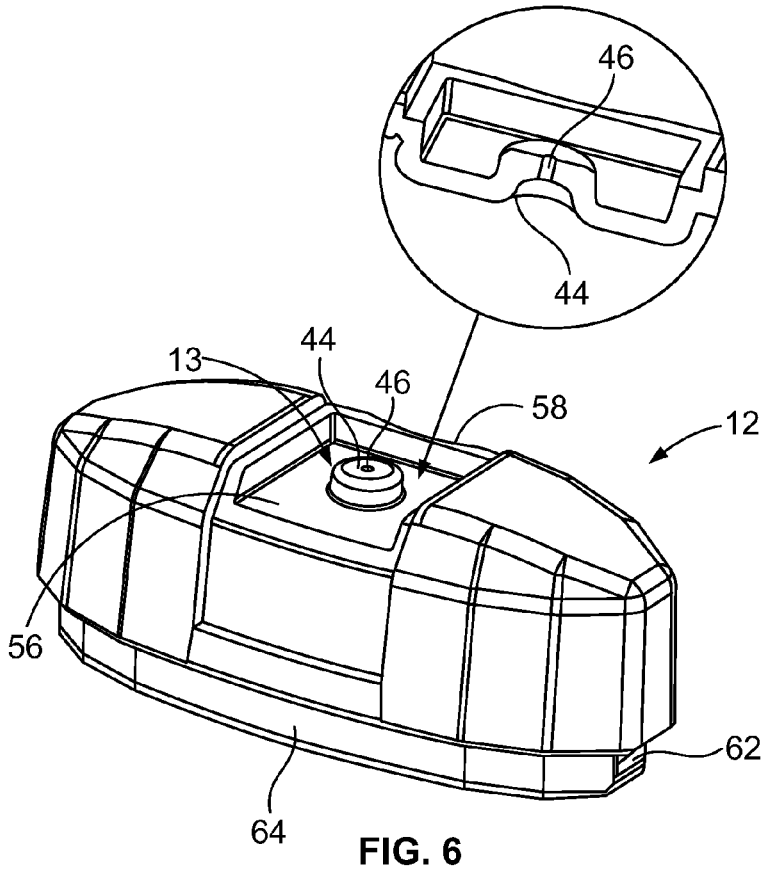
FIG. 6 is a front perspective view of the dispensing closure of the vessel of FIG. 1, also illustrating an enlarged cut away cross section view of the dispensing spout.
Figure 7:
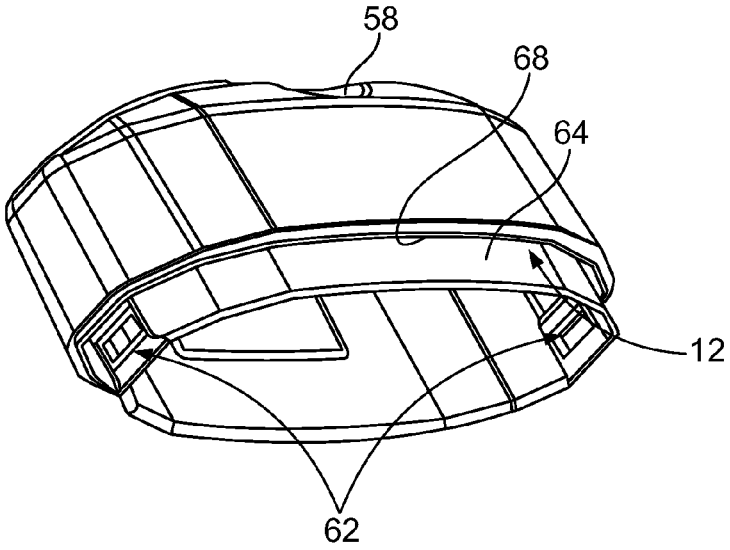
FIG. 7 is a bottom perspective of the dispensing closure of FIG. 6.
Figure 8:
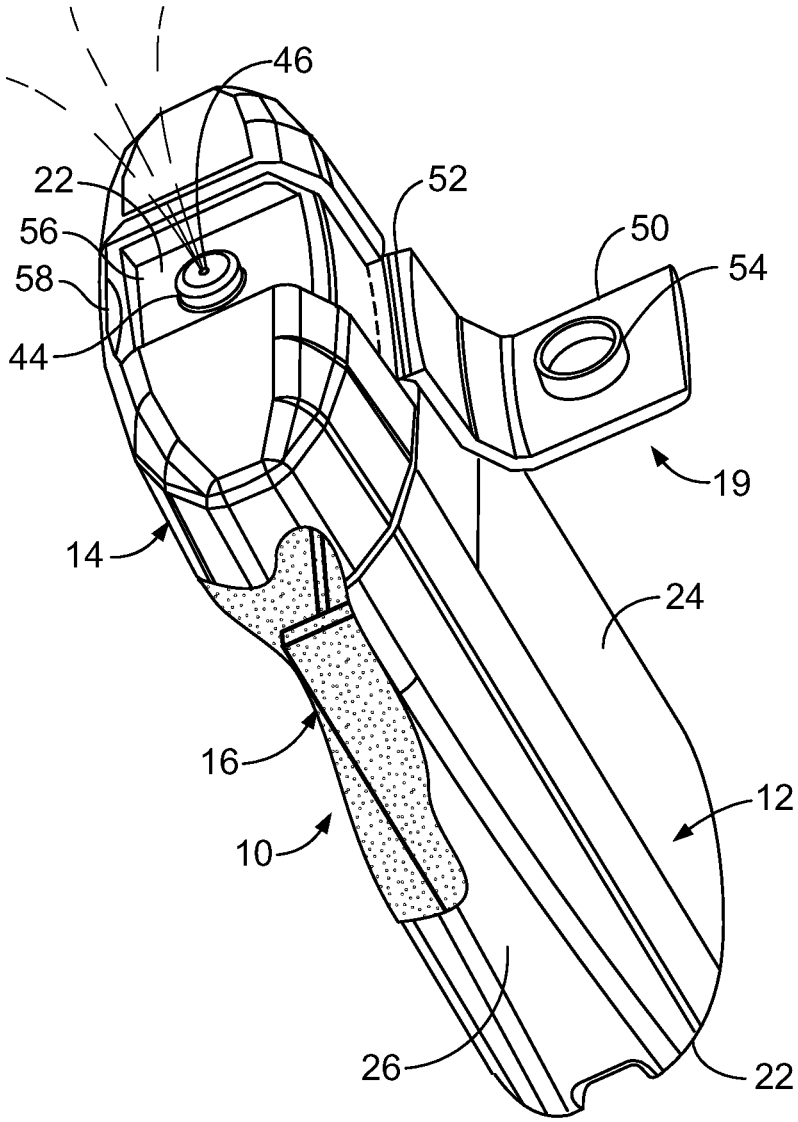
FIG. 8 is a front perspective view of the vessel of FIG. 1 being activated to dispense a predetermined amount of product.

The limiting member 16 in accordance with an illustrated embodiment of the present disclosure is disposed within the bore 32 of the container 12 and extends from and is integral with the base 22 of the container 12. The limiting member 16 has a length that extends parallel to, co-axial with, or otherwise in the same or substantially the same direction as a longitudinal axis of the container 12. The limiting member 16 comprises a pair of rigid members 80 extending between the arcuate walls 24 and an interconnecting member 82 extending substantially perpendicular to and interconnecting the rigid members. The limiting member 16 therefore may have an "H-shaped" cross section as illustrated in FIG. 4. Each rigid member 80 has a width extending between the opposed arcuate walls 24 of the container 12 and includes a pair of ends 84 that contact the opposed arcuate walls during squeezing of the container 12. The end surfaces 84 limit deflection of the arcuate walls 24 during squeezing of the container 12. The interconnecting member 82 provides support for the rigid members 80 during squeezing of the container 12. The limiting member 16, including the rigid members 80 and the interconnecting member 82, extends from the base 22 of the container 12 to adjacent the open end 34 of the container 12 and has a length slightly less than the length of the container 12.

The limiting member 16 is configured to allow for, but limit, the displacement of product from the container 12 into the dispensing closure 14 during squeezing of the container 12 and to thereby cause the dispensing closure 14 to dispense a predetermined amount of product from the vessel 10 each time the container is squeezed. The container 12 and limiting member 16 may be designed in any suitable manner and the volume of the predetermined amount may be based on various factors, such as the construction of the limiting member 16, the container 12 and the dispensing closure 14 and the viscosity of the liquid or other product contained in the container 12. For example, when designing the vessel 10 to dispense a certain quantity, the difference in the volume of the container 12 in its relaxed state and the volume of the container in its squeezed state should generally equal the volume of the certain quantity of product. The predetermined amount with respect to the vessel 10 may vary slightly or greatly in each instance of activation depending upon the tolerances of the construction of the vessel 10 and its components and the predictability of the product.

The limiting member 16 may have any other construction, configuration or dimensions and may be engaged or otherwise associated with the container 12 in any other suitable manner in accordance with other embodiments of the present disclosure. For example, the limiting member 16 may instead be secured to or part of the dispensing closure 14 in accordance with other embodiments of the present disclosure provided that the limiting member 16 functions to limit deflection of the arcuate walls 24 of the container 12 or the vessel 10 during squeezing of the container 12. The limiting member 16 may instead be a separate component that is mechanically or otherwise secured within the bore 32 of the container 12 in accordance with other embodiments of the present disclosure provided that the limiting member 16 functions to limit deflection of the arcuate walls 24 of the container 12 or the vessel 10 during squeezing of the container 12.

The initial process to assemble the vessel 10 may occur in any suitable manner. For example, the container 12 may be molded as one piece having the open end 34. The limiting member 16 may be an integral part of this molding. The dispensing closure 14 and the hinged overcap 50, including the living hinge 52, may be molded as a single separate member. After the container 12 is filled with product, the dispensing closure 14 may be snapped into position over the open end 34 of the container 12 with the hinged overcap 50 in the closed position.

To activate the vessel 10 and allow dispensing of product, the user moves the hinged overcap 50 to its open position. The user then inverts the vessel 10 causing its contents to travel towards the spout 44 and squeezes the container 12 causing the arcuate walls 24 to deflect inwardly. This action causes product to travel from the container 12 to the dispensing closure 14 and causes a limited amount of the product to be dispensed though the flow opening 46 of the spout 44 of the dispensing closure 14. After squeezing, the container 12 returns to its relaxed state. The container 12 can be squeezed additional times to dispense additional predetermined amounts of the product.

The actual amount of product that is being dispensed with each squeezing may depend upon the construction of the vessel 10, including, for example, the configuration and size of the limiting member 16 and the dispensing closure 14 and the container 12. The ability to control the actual amount of product that is being dispensed with each squeezing may depend upon the tolerances used in the construction of the vessel. For example, a vessel 10 intended for use with dispensing of medical products may employ tighter tolerances than a vessel 10 for other applications that do not require precision in dispensing identical amounts each time. The limiting member 16 limits the inward deflection of the arcuate walls 24 of the container 12 and prevents or limits over dispensing of product from the vessel 10. When squeezing pressure is relieved from the arcuate walls 24 of the container 12, the arcuate walls return to their normal relaxed state, a volume of air is drawn back into the container 12, and the vessel 10 is ready again to dispense another predetermined amount of product. This vessel 10 can be used to dispense over and over again until the product has been depleted. Depending on the application, the vessel 10 may be re-fillable and re-useable.

The vessel 10 in accordance with one or more embodiments of the present disclosure 14 is able to repeatedly dispense substantially the same amounts of product during each activation. The limiting member 16 limits the volume that can be dispensed by the user and avoids over dispensing of the product. The vessel 10 may be used to dispense the predetermined amounts for individual uses or application. The vessel 10 may instead or in addition be used to dispense a predetermined amount that is dispensed in multiples. For example, if the vessel 10 dispenses one ounce of liquid and four ounces are desired, the user may squeeze the container 12 four times before use or application of the product. The vessel 10 in accordance with embodiments of the present disclosure may be used for any product, including, including water, soda juices and other beverages, condiments, extracts, creams, ointments, cleaners, oils, detergents and any other suitable consumer products, industrial products, etc. The vessel 10 may also be used to control doses of medication and thus also has important applications in the medical and health care industries. The vessel 10 in accordance with the present disclosure 14 may be easy and cost effective to manufacture.

While embodiments have been illustrated and described in the drawings and foregoing description, such illustrations and descriptions are considered exemplary and not restrictive in character, it being understood that only illustrative embodiments have been shown and described and that all changes and modifications that come within the spirit of the invention are desired to be protected. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure.

What I claim:

1. A vessel configured to contain liquid, semi-solid or powder product and to dispense predetermined amounts of the product, the vessel comprising a dispensing closure defining a flow opening;

a container engaged with the dispensing closure having a relaxed state, the container being squeezable to inwardly deflect the container from its relaxed state to displace some of the product from the container into the dispensing closure for dispensing through the flow opening one of the predetermined amounts of the product and being flexible to return to its relaxed state after the squeezing, the container thereafter being squeezable to inwardly deflect the container from its relaxed state to displace some more of the product from the container into the dispensing closure for dispensing an other of the predetermined amounts of product through the flow opening and being flexible to return to its relaxed state after the squeezing, the container includes a pair of opposed walls that are squeezable towards each other; and a limiting member for limiting inward deflection of the container during each squeezing of the container to limit the amount of product displaced from the container into the dispensing closure and to enable the same amount of product to be dispensed with each repeated deflection of the container, the limiting member is disposed between the opposed walls and has a length that extends in substantially the same direction as a longitudinal axis of the container, the limiting member has an H-shaped cross section along at least a portion of its length.

2. The vessel of claim 1 wherein the limiting member has the H-shaped cross section substantially along its length.

3. The vessel of claim 1 wherein the limiting member includes a pair of rigid members each having a width that extends between the pair of opposed walls and each having a pair of opposed ends, the ends configured to contact the opposed walls during squeezing of the container to limit the inward deflection of the opposed walls.

4. The vessel of claim 3 wherein the rigid members each have a length that extends in substantially the same direction as a longitudinal axis of the vessel.

5. The vessel of claim 3 wherein the rigid members are substantially parallel to each other and wherein the limiting member further includes an interconnecting member interconnecting the two rigid members.

6. The vessel of claim 5 wherein the interconnecting member has a width extending generally perpendicular to the widths of the rigid members and has a length that extends in substantially the same direction as the longitudinal axis of the container.

7. The vessel of claim 1 wherein the opposed walls are arcuate and are symmetrical to each other about a longitudinal axis of the vessel.

8. The vessel of claim 1 wherein the container defines a bore and the limiting member is disposed within the bore.

9. The vessel of claim 8 wherein the dispensing closure further includes a living hinge secured to the overcap.

10. The vessel of claim 1 wherein the dispensing closure includes an overcap movable between open and closed positions to open and close the flow opening.

11. The vessel of claim 1 wherein the length of the limiting member is substantially the same as a length of the container.

12. The vessel of claim 11 wherein the limiting member extends from a base of the container to adjacent an end of the container.

13. A re-fillable and re-useable vessel configured to contain a liquid, semi-solid or powder product and to dispense predetermined amounts of the product, the vessel comprising a dispensing closure defining a flow opening;

a container engaged with the dispensing closure and having a pair of opposed walls defining a bore for receiving the product and having a relaxed state, the container being squeezable to inwardly deflect from its relaxed state to cause the opposed walls to deflect inwardly to displace some of the product from the container into the dispensing closure for dispensing one of the predetermined amounts of product through the flow opening and being flexible to return its relaxed state after squeezing, the container thereafter being squeezable to inwardly deflect from its relaxed state to cause the opposed walls to deflect inwardly to displace some more product from the container into the dispensing closure for dispensing an other of the predetermined amounts of product through the flow opening and being flexible to return its relaxed state after squeezing; and a limiting member disposed within the bore between the opposed walls for limiting inward deflection of the opposed walls during each squeezing of the container to limit the amount of product displaced from the container into the dispensing closure and to enable the same amount of product to be dispensed with each repeated deflection of the container, the limiting member has a length that extends in substantially the same direction as a longitudinal axis of the vessel and has an H-shaped cross section along at least a portion of its length.

14. The vessel of claim 13 wherein the limiting member includes a pair of spaced apart rigid members, each rigid member having a width that extends between the pair of opposed walls and having a pair of opposed ends, the ends configured to contact the opposed walls during squeezing of the containers to limit the inward deflection of the opposed walls, each rigid member having a length that extends in substantially the same direction as a longitudinal axis of the vessel.

15. The vessel of claim 14 wherein the rigid members extend substantially parallel to each other and wherein the limiting member further includes an interconnecting member interconnecting the two rigid members.

16. A vessel configured to contain liquid, semi-solid or powder product and to dispense predetermined amounts of the product, the vessel comprising a dispensing closure defining a flow opening;

a container having an end with the dispensing closure coupled thereto, the container having walls that are squeezable to inwardly deflect the container from its relaxed state to displace product from the container into the dispensing closure for dispensing through the flow opening and being flexible to return to its relaxed state after the squeezing, the container having an opposite end coupled to the walls; and a limiting member having a length that extends in substantially the same direction as a longitudinal axis of the container for limiting inward deflection of the container during each repeated squeezing of the container to limit the amount of product displaced from the container into the dispensing closure and to enable the same amount of product to be dispensed with each repeated deflection of the container, the limiting member having first and second parallel rigid members disposed between the opposed walls when the container is in its relaxed state and with a third rigid member joined to each of the first and second parallel rigid members so as to prevent movement of the first and second parallel rigid members with respect to each other during each repeated deflection of the container.

* * * * *